US011124359B1

(12) United States Patent
Gensicke et al.

(10) Patent No.: US 11,124,359 B1
(45) Date of Patent: Sep. 21, 2021

(54) RECEPTACLE

(71) Applicant: ADOPT-A-HIGHWAY MAINTENANCE CORPORATION, Costa Mesa, CA (US)

(72) Inventors: Joshua Gensicke, Anaheim, CA (US); Jesus J. Pena, Yorba Linda, CA (US); Rishi Saran, Orange, CA (US); Patricia Nelson, Costa Mesa, CA (US)

(73) Assignee: ADOPT-A-HIGHWAY MAINTENANCE CORPORATION, Costa Mesa, CA (US)

( * ) Notice: Subject to any disclaimer, the term of this patent is extended or adjusted under 35 U.S.C. 154(b) by 0 days.

(21) Appl. No.: 16/659,447

(22) Filed: Oct. 21, 2019

Related U.S. Application Data

(63) Continuation of application No. 15/709,302, filed on Sep. 19, 2017, now Pat. No. 10,450,135.

(60) Provisional application No. 62/451,551, filed on Jan. 27, 2017.

(51) Int. Cl.

| | |
|---|---|
| ***B65F 1/16*** | (2006.01) |
| ***B65F 1/02*** | (2006.01) |
| ***B65F 1/14*** | (2006.01) |
| ***E05D 11/06*** | (2006.01) |

(52) U.S. Cl.
CPC ..... *B65F 1/1646* (2013.01); *B65F 1/02* (2013.01); *B65F 1/141* (2013.01); *B65F 1/1468* (2013.01); *E05D 11/06* (2013.01); *B65F 2001/1669* (2013.01); *B65F 2210/132* (2013.01); *B65F 2210/148* (2013.01); *B65F 2230/00* (2013.09); *B65F 2230/116* (2013.01); *B65F 2230/126* (2013.01); *B65F 2230/152* (2013.01); *B65F 2250/1143* (2013.01)

(58) Field of Classification Search
CPC ..... B65F 1/1646; B65F 1/141; B65F 1/1468; B65F 1/02; B65F 2250/1143; B65F 2230/152; B65F 2210/132; B65F 2001/1669; B65F 2230/116; B65F 2230/00; B65F 2230/126; B65F 2210/148; E05D 11/06
See application file for complete search history.

(56) References Cited

U.S. PATENT DOCUMENTS 2,440,474 A * 4/1948 Jackler ..... A45C 13/083 428/52
4,325,492 A * 4/1982 Kunze ..... B65D 21/0233 220/831
4,726,616 A * 2/1988 Schmidt ..... B65F 1/122 294/68.2

(Continued)

*Primary Examiner* — Kareen K Thomas
(74) *Attorney, Agent, or Firm* — Rutan & Tucker, LLP

(57) ABSTRACT

A receptacle comprising a container and a lid is disclosed. The container includes one or more walls and a plurality of gussets extending from the container. The gussets include a first gusset having a cavity facing away from a second gusset. The lid includes a plurality of hinge components, namely a first hinge component including a first pin. The lid is pivotally coupled to the container by inserting the first pin of the first hinge component into the cavity of the first gusset and using a second pin to rotationally couple the second hinge component to the second gusset. A first protrusion, extending from the first hinge component, is configured to contact the first gusset and restrict opening of the lid.

21 Claims, 14 Drawing Sheets

(56) References Cited

U.S. PATENT DOCUMENTS

| | | | | | |
|---|---|---|---|---|---|
| 5,048,715 | A * | 9/1991 | Wolff | B65D 43/168 | 220/832 |
| 5,361,455 | A * | 11/1994 | Kiefer | E05D 3/022 | 16/235 |
| 5,529,205 | A * | 6/1996 | Corney | B65D 43/164 | 220/832 |
| 7,100,791 | B2 * | 9/2006 | Berger | B65F 1/122 | 220/380 |
| 2006/0103086 | A1 * | 5/2006 | Niemeyer | B65F 1/163 | 280/47.26 |
| 2008/0237251 | A1 * | 10/2008 | Barber | B65F 1/122 | 220/810 |
| 2009/0127809 | A1 * | 5/2009 | Meers | B65F 1/16 | 280/47.26 |
| 2010/0090428 | A1 * | 4/2010 | Meers | E05C 19/06 | 280/47.26 |

* cited by examiner

RECEPTACLE

CROSS-REFERENCE TO RELATED APPLICATIONS

This application is a Continuation of U.S. Non-Provisional application Ser. No. 15/709,302, now U.S. Pat. No. 10,450,135, which claims the benefit of priority of U.S. Provisional Application No. 62/451,551, filed Jan. 27, 2017, the entire contents of which are incorporated by reference herein.

FIELD

Embodiments of the invention relate to the field of containers, including a molded receptacle without metal hardware.

BACKGROUND

In efforts to maintain pristine beaches along our coastline, many coastal counties deploy receptacles for beachgoers to deposit trash that they have accumulated during their beach outing. Generally, these trash receptacles are made of polyethylene or another type of hardened plastic material. In many situations, these trash receptacles do not include lids, which allow birds and other wildlife to access spoiled food and other trash. This is harmful to the wildlife and causes unsanitary conditions at the beach.

To address this situation, trash receptacles with attached lids have been deployed. The opening and closing of these attached lids are guided by components that include metal hardware. Given constant exposure to environmental conditions near the ocean (e.g., fog, increased concentration of salt in the air, etc.), the metal hardware tends to corrode. Hence, during use, the lids can become disengaged from the trash receptacle. As a result, the useful lifetime of the trash receptacles is less than optimal. Furthermore, given that there is no restriction in the rotation of the attached lids, in many cases, the lids may not be closed by users, which again allows wildlife access to trash as described above.

BRIEF DESCRIPTION OF THE DRAWINGS

The invention may best be understood by referring to the following description and accompanying drawings that are used to illustrate embodiments of the invention. In the drawings.

DETAILED DESCRIPTION

In the following description, numerous specific details are set forth. However, it is understood that embodiments of the invention may be practiced without these specific details. In other instances, well-known structures and techniques have not been shown in detail in order not to obscure the understanding of this description. Those of ordinary skill in the art, with the included descriptions, will be able to implement appropriate functionality without undue experimentation.

References in the specification to "one embodiment" or "an embodiment," may indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that such feature, structure, or characteristic may be deployed in connection with other embodiments whether or not explicitly described.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

Figure 1:
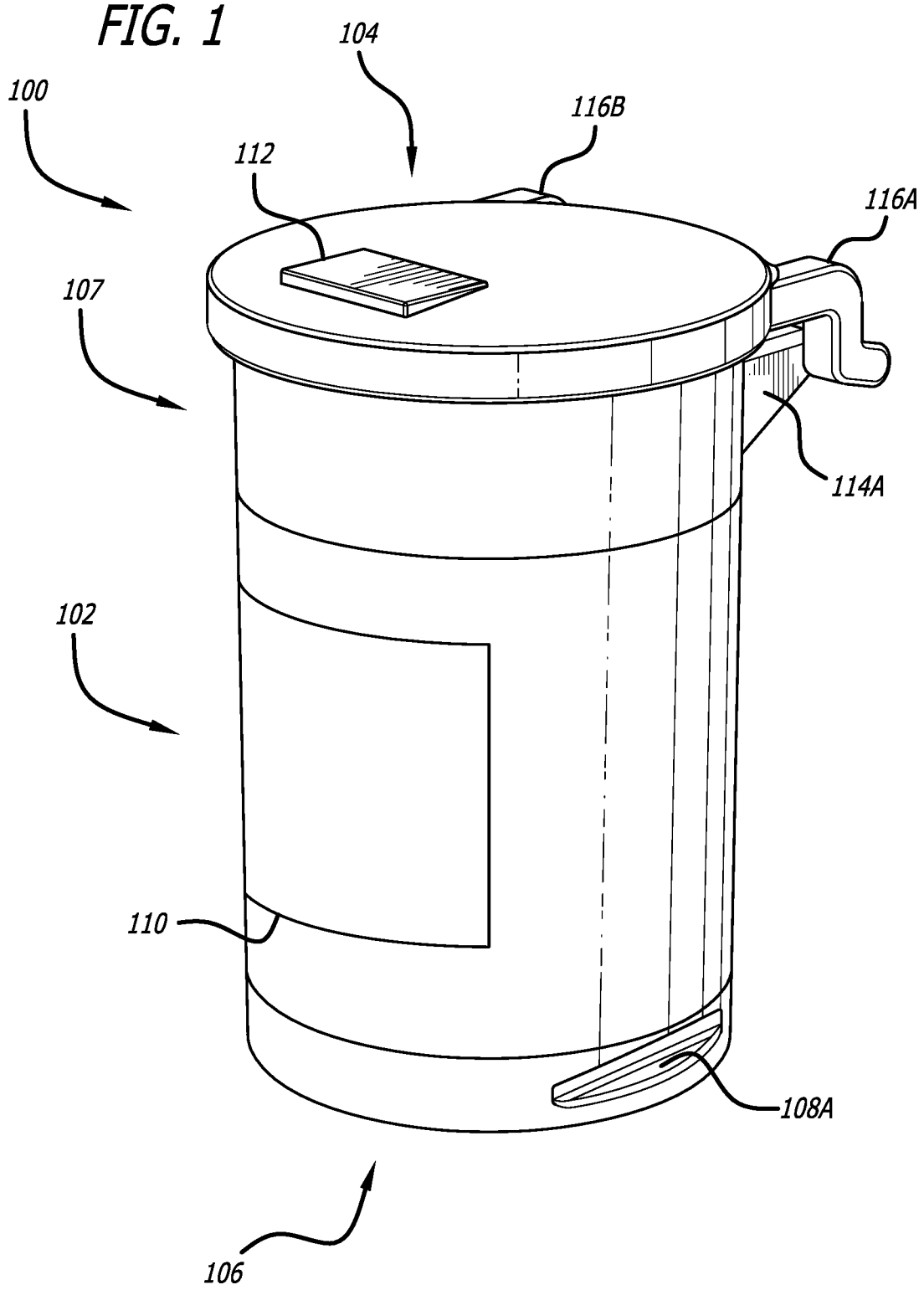
FIG. 1 illustrates a front perspective view of a receptacle according to a first embodiment of the present invention.

Referring to FIG. 1, an exemplary illustration of a front perspective view of a receptacle 100 according to a first embodiment of the disclosure is shown. The receptacle 100 can be utilized for storing objects, for example trash and/or recyclable materials. The receptacle 100 includes a container 102 and a lid 104. The container 102 may have a cylindrical shape, e.g., referred to as a barrel, as shown in FIG. 1, but may take a variety of alternative cross-sectional shapes having one or more walls. Example of shapes may include, but are not limited or restricted to, a triangle, a quadrilateral, a pentagon, a hexagon, or any other polygon. Further, the one or more walls of the container 102 can having varying thicknesses. In one embodiment in which the container 102 has a cylindrical shape, the container 102 may have an inner diameter of over twenty inches (e.g., 22.64 inches) and a wall thickness of less than one-quarter (¼) of an inch (e.g., 0.187 inches). Additionally, certain embodiments of the container 102 may have different sizes, e.g., differing in height and/or diameter from the examples discussed herein. Various embodiments of the receptacle 100 may include a 50 gallon container, a 55 gallon container, a 60 gallon container, etc. A base portion 106 of the container 102 is discussed below with respect to FIG. 12.

In certain embodiments, one or more decals 110 can be attached to the container 102. In one embodiment, a decal 110 can be permanently affixed to the receptacle 100 and in a second embodiment, the decal 110 can be removably affixed to the receptacle 100. The decal 110 may include advertisements for companies, classifieds, event promotions, etc. The decal 110 may be one of a variety of sizes including, but not limited or restricted to, heights of approximately 12 inches, 18 inches, 24 inches, etc. The decal 110 can also be wrapped around all or a centralized portion 109 of the container 102 that is located between the top portion 107 and the base portion 106 of the container 102. It is contemplated that the centralized portion 109 may be non-planar with the top portion 107 and the base portion 106 of the container 102 (e.g., raised to provide higher visibility of the decal 110). As an alternative embodiment, the decal 110 may be placed within a recess of the container 102 (not shown) such that a face of the decal 110 is planar with respect to the top portion 107 and the base portion 106 of the container 102.

The receptacle 100 also includes two protrusions (referred to as "knuckles") 114A-114B that are attached to the container 102 and serve as the location at which the lid 104 couples to the container 102. Although only knuckle 114A is seen in FIG. 1, both knuckles 114A-114B are illustrated in at least FIGS. 4-6. In one embodiment, the knuckles 114A-114B are gusset-like protrusions that are integrally molded with the container 102 so that the knuckles 114A-114B and the container 102 are formed as a single piece. In one embodiment, the container 102 and the lid 104 may be rotationally molded in polyethylene. The knuckles 114A-114B may be configured at an angle of approximately 30 degrees relative to the container 102. The disclosure should not be limited such that the receptacle 100 is restricted to two knuckles. Instead, the receptacle 100 may include a single knuckle to which the hinge components 116A-116B couple. Additional embodiments may include three or more knuckles.

Figure 4:
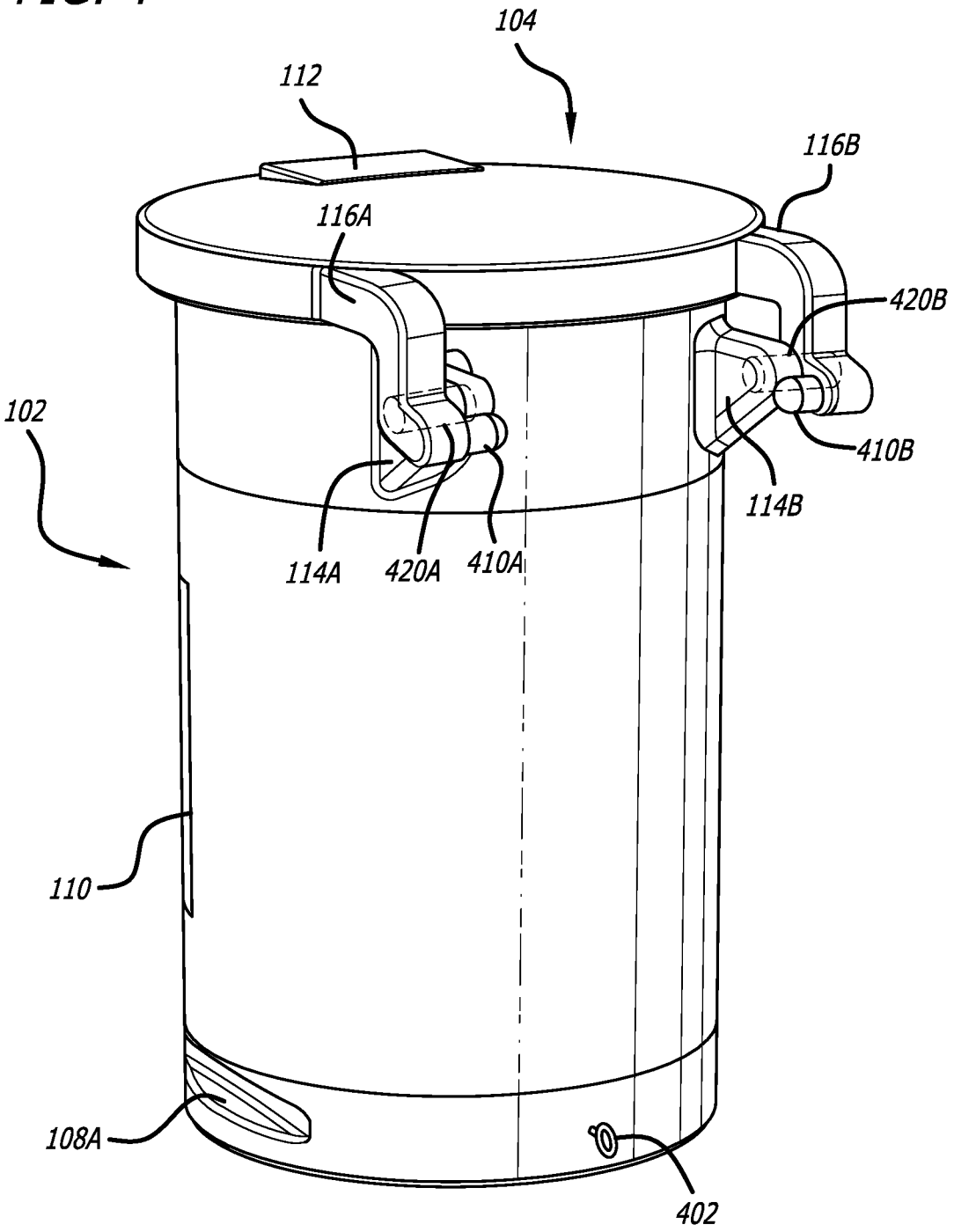
FIG. 4 illustrates a rear perspective view of the receptacle of FIG. 1.

As further shown in FIG. 1, the base portion 106 of the container 102 may include one or more recesses, cavities or grooves 108A (hereinafter referred to as "recesses" or "a recess") that may be configured to aid in securing a security chain wrapped around the receptacle 100. Additionally, as is illustrated in FIG. 4, a hook 402 can be threadably inserted to the container 102 and configured to secure the receptacle 100 in a predetermined location with a security chain. In one embodiment, a bolt may be coupled to a threaded portion of the hook 402 at an interior side of the container 102.

The lid 104 can be hingedly coupled with the container 102. Two hinge components 116A-116B are attached to the lid 104 and are configured to couple the lid 104 with the container 102 via the knuckles 114A-114B. In one embodiment, the hinge components 116A-116B may be integrally formed with the lid 104 and formed as a single component. In one embodiment, the lid 104 may additionally include one or more decals, not shown, and/or a raised plate 112. The raised plate 112 may have various sizes and shapes and may include advertisements for companies, classifieds, event promotions, etc., and/or printed instructions for use and/or how to properly empty the receptacle 100. As will be discussed below and as illustrated in at least FIG. 4, the two hinge components 116A-116B may each include a stop pin and a pivot pin. For example, the hinge component 116A may include the stop pin 410A and the pivot pin 420A.

Figure 2:
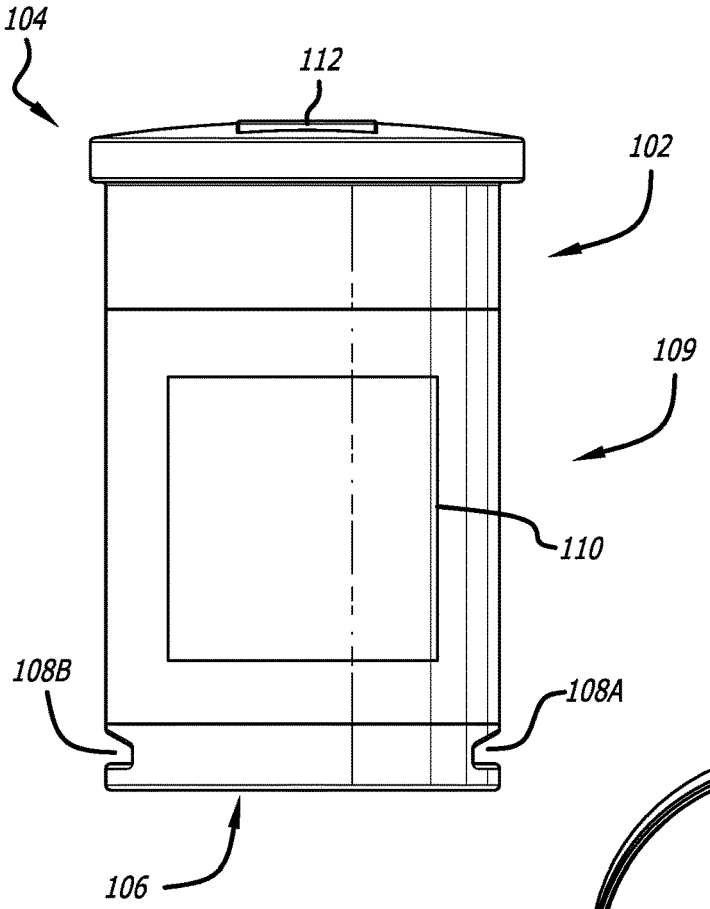
FIG. 2 illustrates a second front perspective view of the receptacle of FIG. 1.
Figure 3:
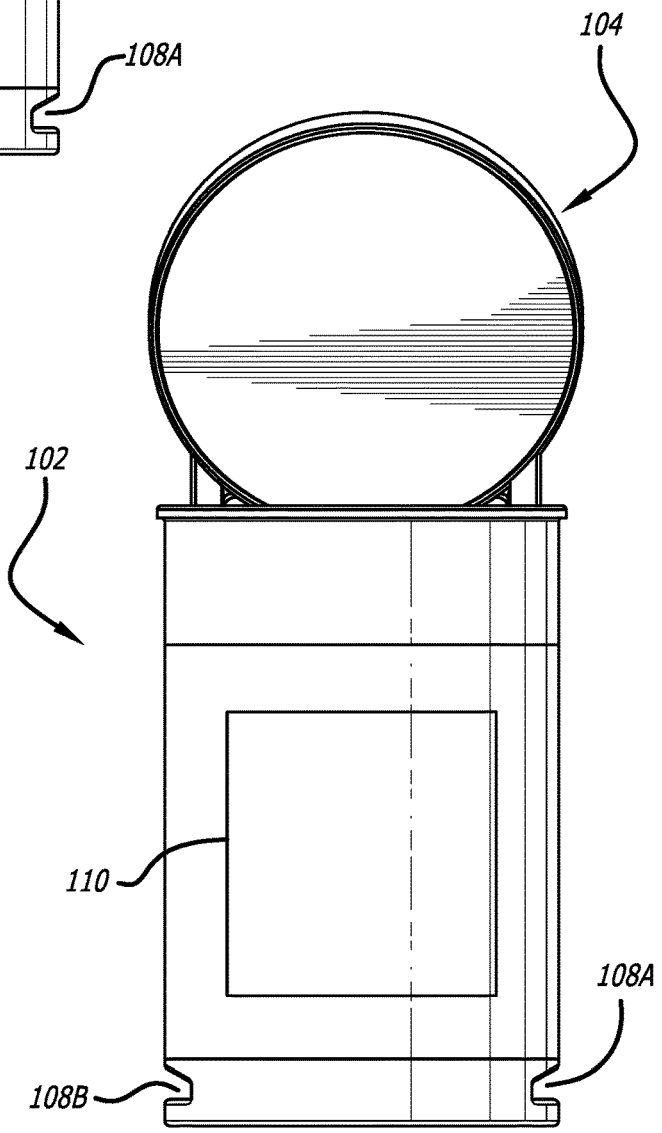
FIG. 3 illustrates a third front perspective view of the receptacle of FIG. 1 having an open lid.

Referring to FIG. 2, an exemplary illustration of a second front perspective view of the receptacle of FIG. 1 is shown. FIG. 2 illustrates the receptacle 100 having a plurality of recesses 108A-108B in the container 102. The disclosure is not intended to limit the number of recesses. Additionally, although not shown, the receptacle 100 may include one or more the handles, grips or grooves that may be located at various positions on the container 102 to aid in moving and/or emptying the receptacle 100. For example, the one or more handles may be located at the base portion 106 of the container 102, the top end of the container 102 near the lid 104, one the lid 104 and/or near the midpoint of the container 102. FIG. 2 provides one exemplary illustration of the decal 110 attached to the container 102, e.g., wrapped around the container and covering a majority of at least the front, centralized portion 109 of the container 102. Additionally, as illustrated in FIG. 2, one embodiment of the receptacle 100 may be sized as follows: the container 102 being approximately 38.50 inches tall and the lid 104 being approximately 25 inches wide. However, the disclosure is not intended to be limited to these measurements and the components of the receptacle 100 may have other measurements. FIG. 3 provides an exemplary illustration of a third front perspective view of the receptacle of FIG. 1 having an open lid 104 is shown. The mechanism responsible for enabling the lid 104 to open and be hingedly coupled to the container 102 is discussed in detail below with respect to at least FIGS. 4-9.

Referring now to FIG. 4, an exemplary illustration of a rear perspective view of the receptacle 100 of FIG. 1 is shown. The rear view of the receptacle 100 illustrates the coupling of the hinge components 116A-116B and the knuckles 114A-114B. The lid 104 couples to the container 102 via the coupling of the hinge components 116A-116B with the knuckles 114A-114B. In particular, each hinge component 116A-116B includes a pivot pin (the pivot pins 420A-420B). The pivot pin 420B, illustrated in FIG. 4 using dotted lines, is shown as being inserted into a cavity of the knuckle 114B. The insertion of the pivot pins 420A-420B into corresponding cavities of the knuckles 114A-114B secures the lid 104 to the container 102. One benefit provided by coupling the lid 104 and the container 102 via the pivot pins 420A-420B and the knuckles 114A-114B is that no metal components are required in such an embodiment. As it is well-known that metal corrodes, e.g., rusts, due to exposure to the environment, e.g., water, oxygen salt, etc. As discussed above, the knuckles 114A-114B may be integrally formed with the container 102 as a single component. In addition, the lid 104 may be integrally formed with the hinge components 116A-116B and the pivot pins 420A-420B. Therefore, without using metal when coupling the lid 104 to the container 102, the coupling components of the receptacle 100 will not corrode and fall apart. Therefore, the receptacle 100 provides significant benefit over alternative receptacle options that utilize metal components, especially when used to couple the lid to the container.

Additionally, the knuckles 114A-114B are configured such that each contacts the corresponding stop pin 410A-410B during the rotated opening of the lid 104, thereby preventing the lid 104 from opening beyond a predetermined angle. Thus, as the lid 104 is opened, the lid 104 and the hinge components 116A-116B rotate about the knuckles 114A-116B. When the lid 104 is opened to the predetermined maximum angle, the stop pins 410A-410B contact the corresponding knuckle 114A-114B and prevent the lid 104 from opening any further. Although FIG. 4 illustrates each hinge component 116A-116B including a stop pin 410A-410B, an alternative embodiment may only include one of the hinge components 410A-410B having a stop pin.

Figure 5:
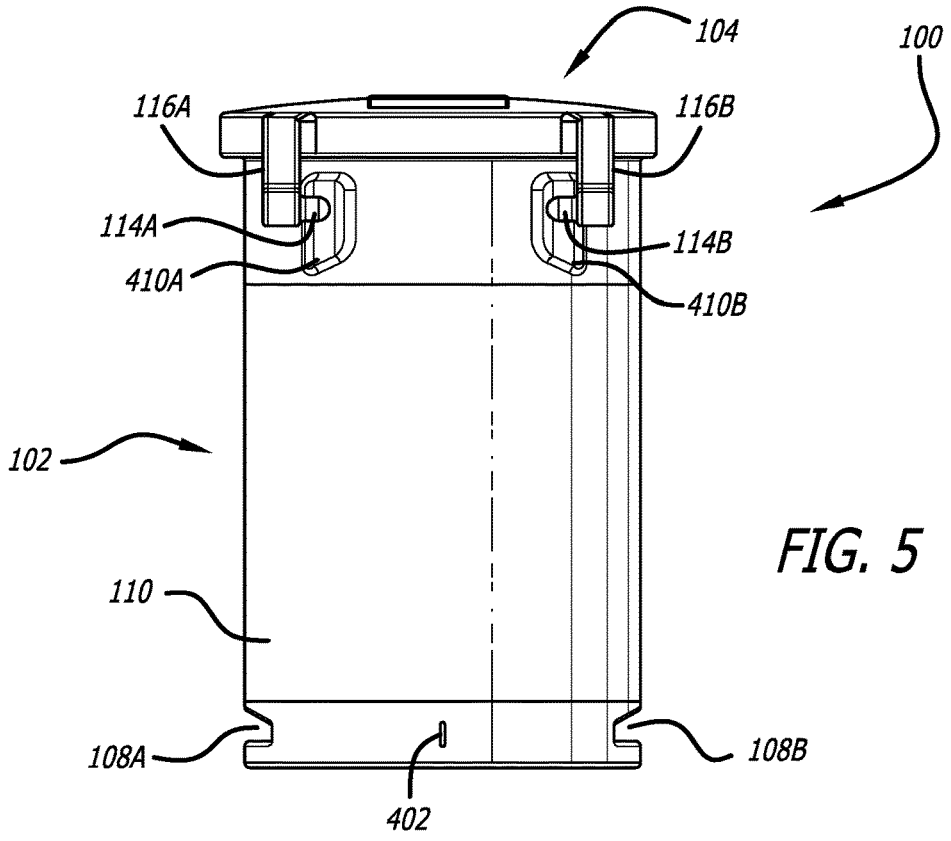
FIG. 5 illustrates a second rear perspective view of the receptacle of FIG. 1.

Further, the receptacle 100 may include one or more hooks 402, e.g., an eye bolt, that can be used to secure the receptacle 100 at a certain location, e.g., at a particular street location or location on the beach, or to a particular item, e.g., a truck, a bench, a stake, or a lifeguard tower. The hook 402 can secure the receptacle 100 via a chain and lock combination or with an alternative locking method. In one embodiment, the hook 402 may be located near the base of the container 102. Further, a chain can attach to the hook 402 and wrap around the base portion 106 of the container 102 and rest in the recesses 108A-108B. In alternative embodiments, the hook 402 can be located elsewhere on the receptacle 100 with one or more recesses provided parallel locations (e.g., as shown in FIG. 4). FIG. 5 provides an exemplary illustration of a second rear perspective view of the receptacle 100 and FIG. 6 provides an exemplary illustration of a third rear perspective view of the receptacle 100 having an open lid 104.

Figure 7:
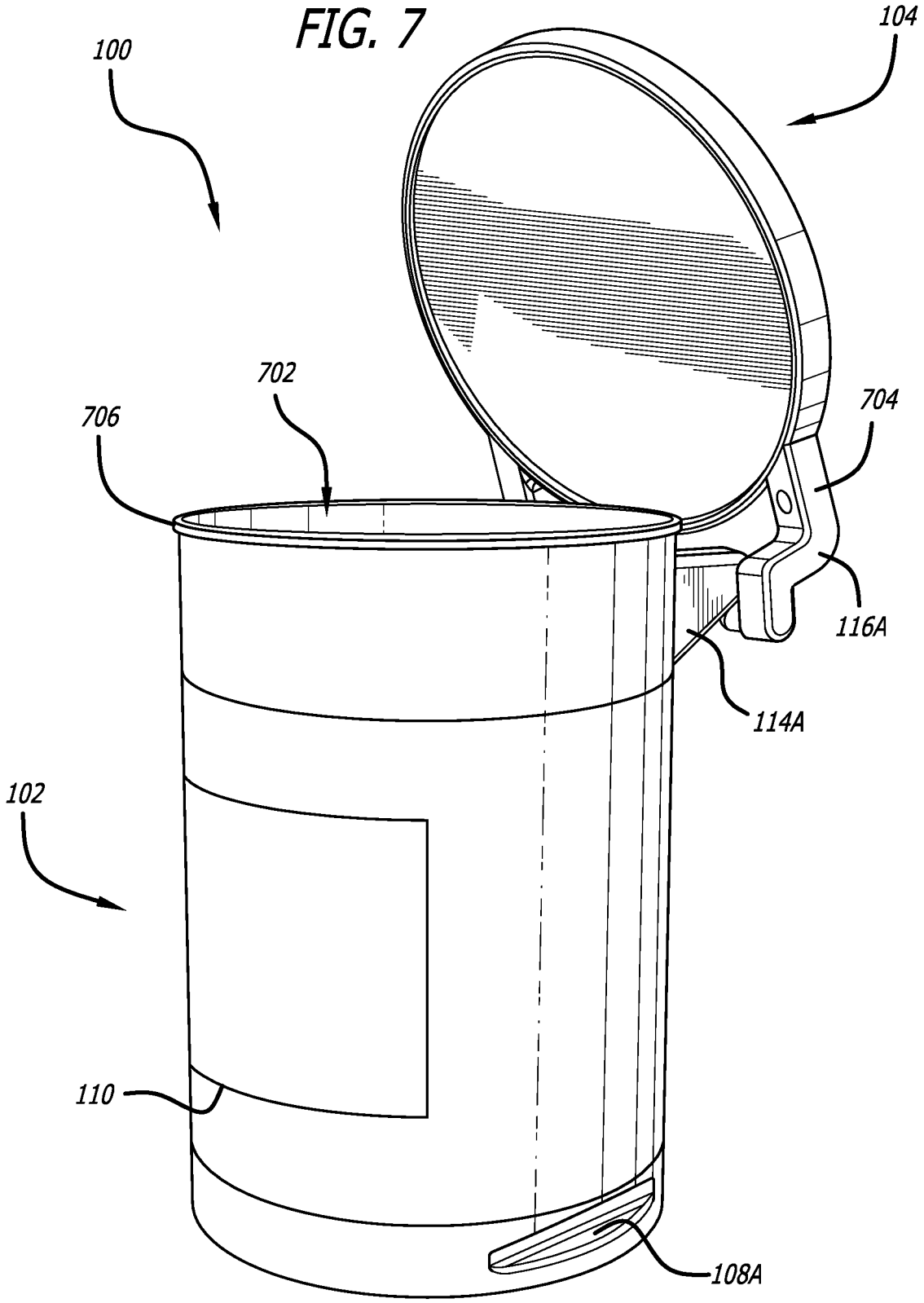
FIG. 7 illustrates a side perspective view of the receptacle of FIG. 1 having an open lid.

Referring now to FIG. 7, an exemplary illustration of a side perspective view of the receptacle 100 of FIG. 1 having an open lid 104 is shown. The receptacle 100, shown with the opened lid 104, is configured such that the lid 104 may only open a predetermined amount, e.g., a maximum angle between the top of the container 102 and the inner surface of the lid 104. In one embodiment, the maximum angle may be less than ninety (90) degrees, such as seventy-two (72) degrees for example. Other embodiments may have alternative predetermined maximum angles.

Figure 8:
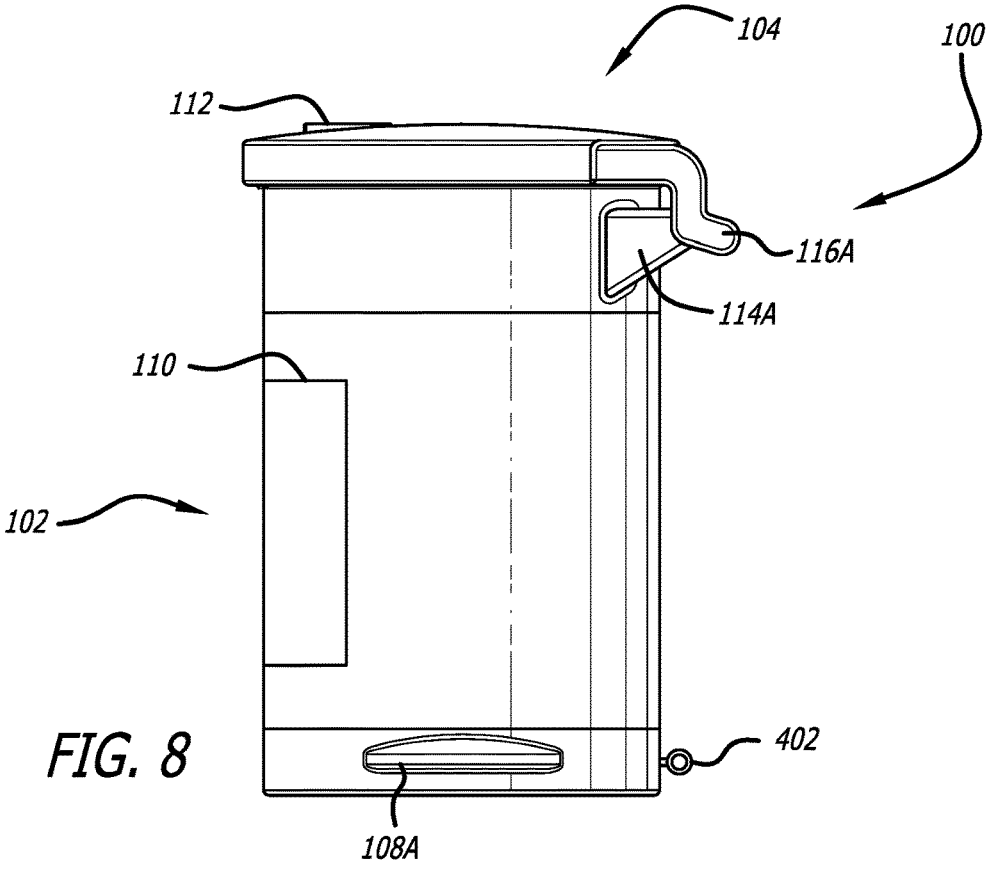
FIG. 8 illustrates a second side perspective view of the receptacle of FIG. 1.
Figure 6:
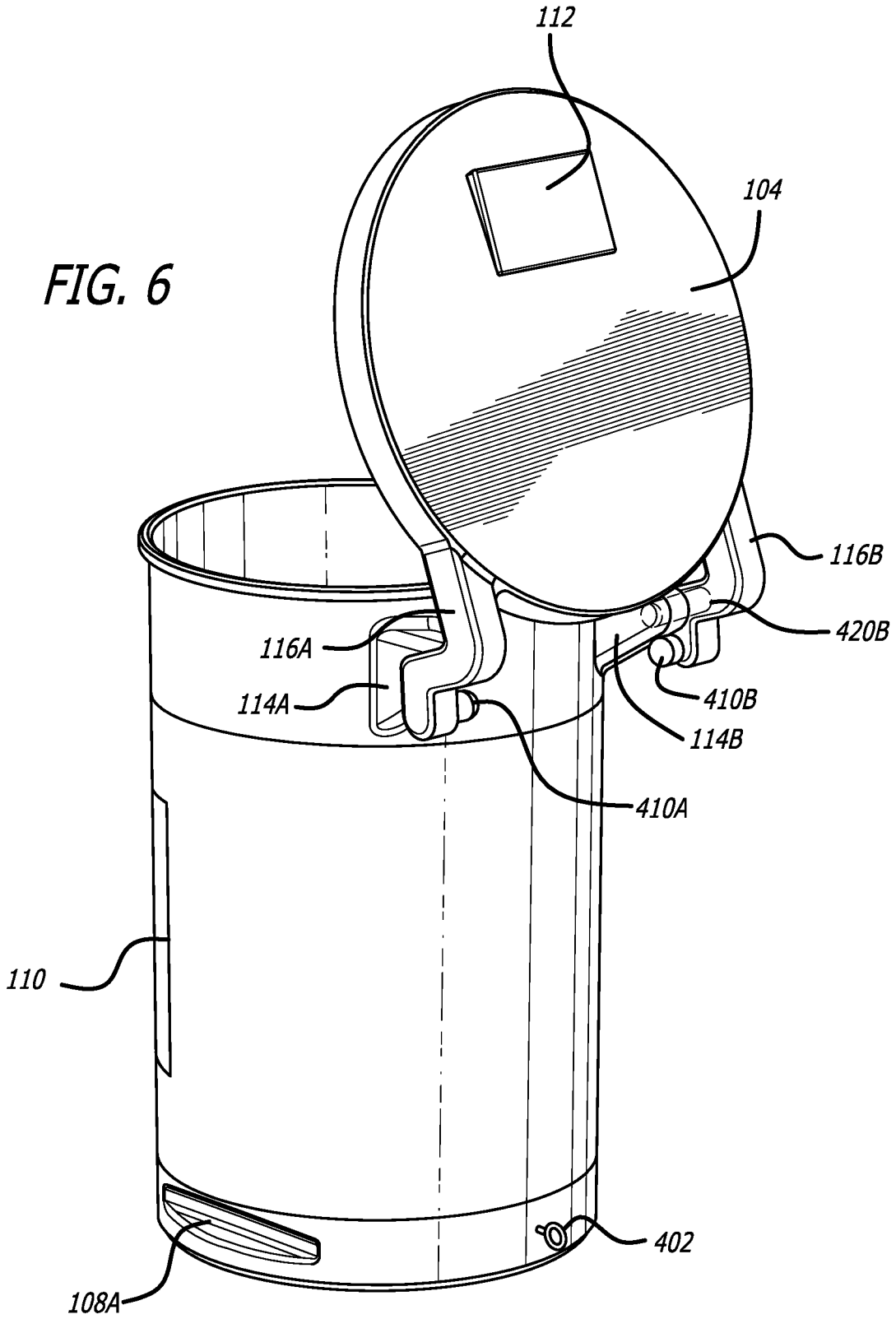
FIG. 6 illustrates a third rear perspective view of the receptacle of FIG. 1 having an open lid.

Stop pins 410A-410B, illustrated in FIGS. 4-6, are configured to contact the knuckles 114A-114B, thereby preventing the lid 104 from opening beyond the predetermined angle. Configuring the receptacle 100 to prevent the lid 104 from opening beyond the predetermined angle may predispose the lid 104 to close after an item has been placed in the receptacle 100 without additional activity needed by the user. A predisposition of the lid 104 to close after an item has been placed in the receptacle 100 prevents wildlife from entering the receptacle 100 and taking items out of the receptacle 100, which can pollute the area around the receptacle 100, e.g., the beach. Further, the items placed in the receptacles, such as receptacle 100, can be harmful to the wildlife. For example, plastic rings used as packaging for soda or water bottles can be placed in other receptacles and subsequently removed by wildlife if the receptacle's lid is left open. Wildlife may then get tangled in the plastic rings, which can hinder their ability to move or eat and can even choke the animal. Therefore, configuring the lid 104 to be predisposed to close after an item is placed in the receptacle 100 prevents wildlife from removing, or wind from blowing, items out of the receptacle 100. As a result, the receptacle 100 provides a significant benefit over other receptacles. FIG. 7 also illustrates an inner cavity 702 and a lip 706 of the container 102 and that the lid 104 may include a vent hole 704. FIG. 8 provides an exemplary illustration of a second side perspective view of the receptacle 100.

Figure 9:
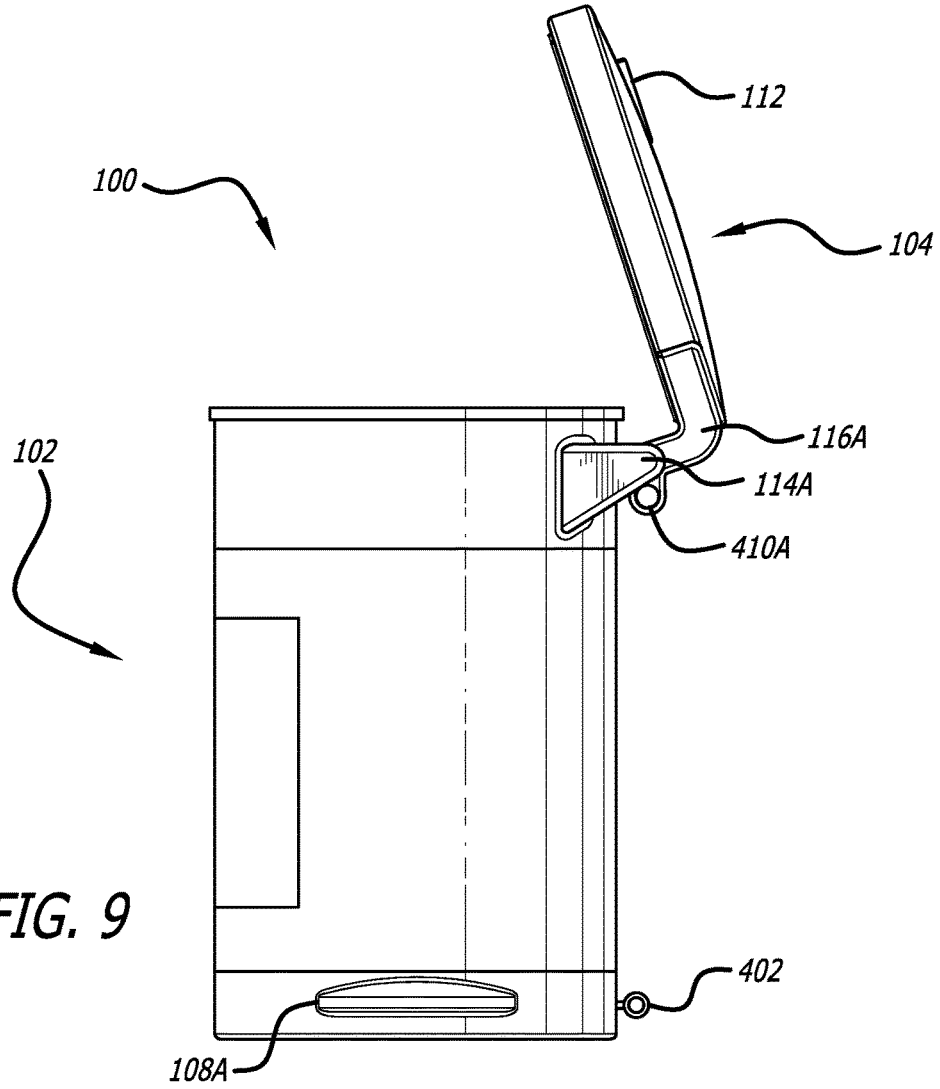
FIG. 9 illustrates a third side perspective view of the receptacle of FIG. 1 having an open lid.
Figure 10:
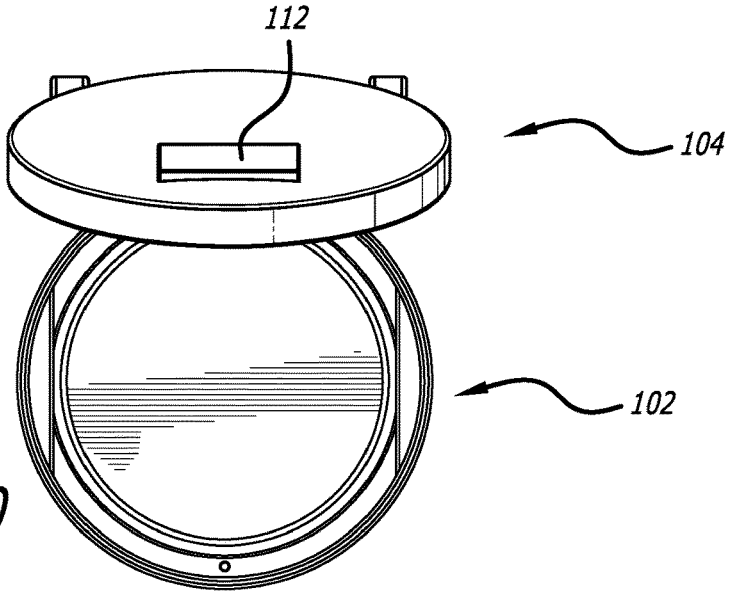
FIG. 10 illustrates a top view of the receptacle of FIG. 1 having an open lid.

Referring now to FIG. 9, an exemplary illustration of a third side perspective view of the receptacle 100 of FIG. 1 having an open lid 104 is shown. FIG. 9 illustrates one embodiment in which the stop pin 410A and the knuckle 114A are configured to come into contact when the lid 104 is opened to a predetermined angle, e.g., 72 degrees. Referring to FIG. 10, an exemplary illustration of a top view of the receptacle 100 with lid 104 being opened is provided.

Figure 11A:
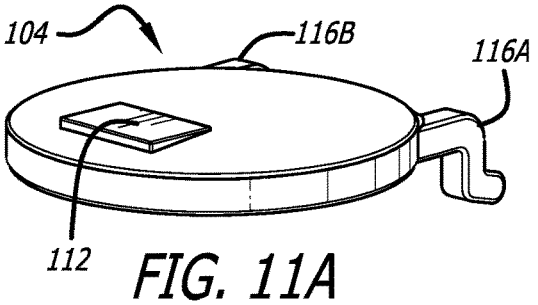
FIG. 11A illustrates a lid that can be used with the receptacle of FIG. 1.
Figure 11B:
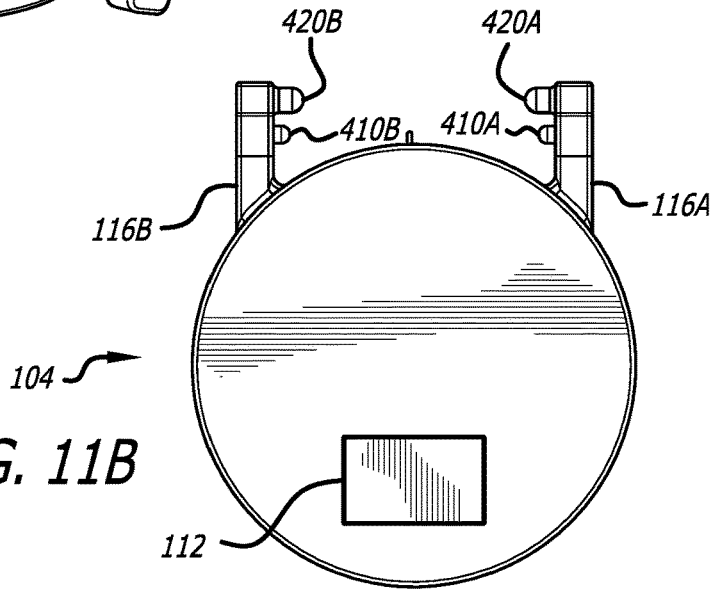
FIG. 11B illustrates a top view of the lid of FIG. 11A.
Figure 11C:
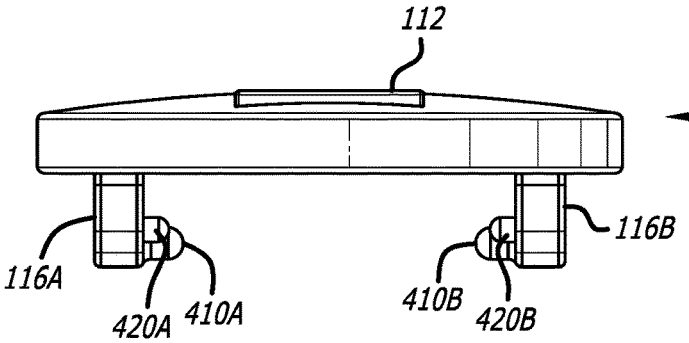
FIG. 11C illustrates a rear view of the lid of FIG. 11A.

FIG. 11A provides an exemplary illustration of the lid 104 and FIG. 11B provides an exemplary illustration of a top view of the lid 104. The top view of FIG. 11B provides an illustration of the hinge component 116A including the stop pin 410A and the pivot pin 420A and the hinge component 116B including the stop pin 410B and the pivot pin 420B. As shown, the pivot pins 420A-420B are located between the lid 104 and the stop pins 420A-420B. Additionally, the pivot pins 420A-420B may be smaller than the stop pins 410A-410B. Although, in alternative embodiments, the pivot pins 420A-420B may be the same size as, or larger than, the stop pins 410A-410B. Referring to FIG. 11C, an exemplary illustration of a rear view of the lid 104 of FIG. 11A is shown. In the embodiment illustrated in FIG. 11C, the lid 104 may possess a thickness of over three (3) inches (e.g., approximately 3.45 inches) and an outer diameter from end of the perimeter of the lid 104 to another end of the perimeter of approximately 25 inches while the hinge components 116A-116B may have a height of approximately 4.02 inches. As discussed above with respect to FIG. 2, these measurements are merely optional and are not intended to limit the disclosure.

Figure 11D:
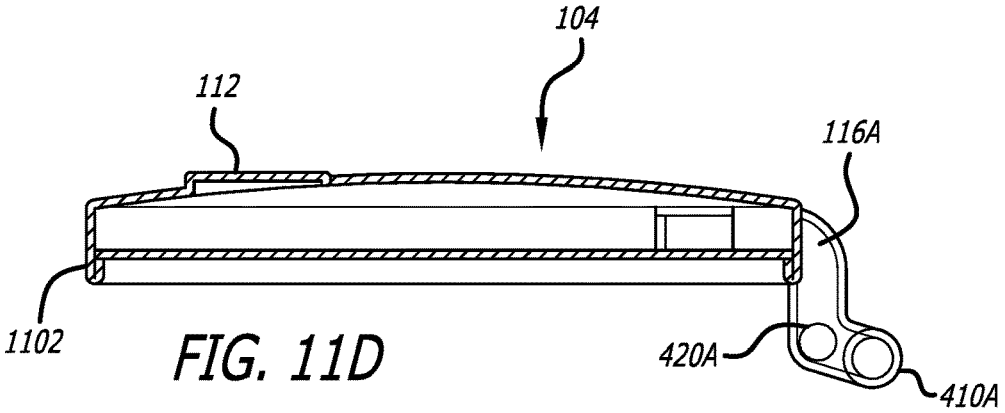
FIG. 11D illustrates a side view of the lid of FIG. 11A.
Figure 11E:
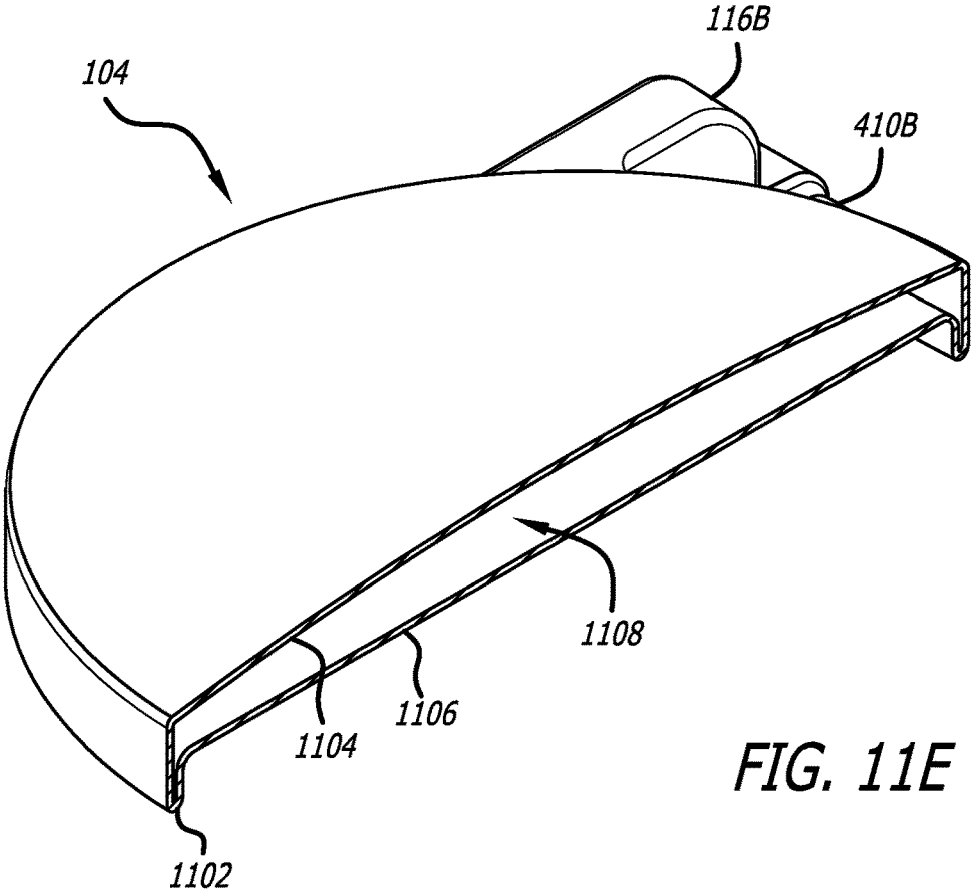
FIG. 11E is a cross-sectional view of the lid of FIG. 11A.

Referring now to FIG. 11D, an exemplary illustration of a side view of the lid 104 of FIG. 11A is shown. FIG. 11D illustrates that the lid 104 may include a lip 1102 having, for example, a height of approximately 0.5 inches and a width of approximately 0.5 inches. The lip 1102 can extend around the entire lid 104 and provide added securement to the closure of the lip 104. For instance, the lip 1102 provides an additional measure that holds the lid 104 in place when closed and making an attempt by wildlife to open the lid 104 of the receptacle 100 difficult. Additionally, the illustration of FIG. 11D provides an example measurement pertaining to the location of the stop pin 410A and the pivot pin 420A (which would similarly apply to the stop pin 410B and the pivot pin 420B). In one embodiment, the center of the stop pin 410A and the pivot pin 420A may be two inches apart. FIG. 11E provides an exemplary illustration of a cross-sectional view of the lid 104 of FIG. 11A. As shown, the lid 104 may include the 1102 lip, an outer wall 1104 and a hollow, inner wall 1106 such that an inner cavity 1108 is formed between the outer wall 1104 and the inner wall 1106.

Figure 12:
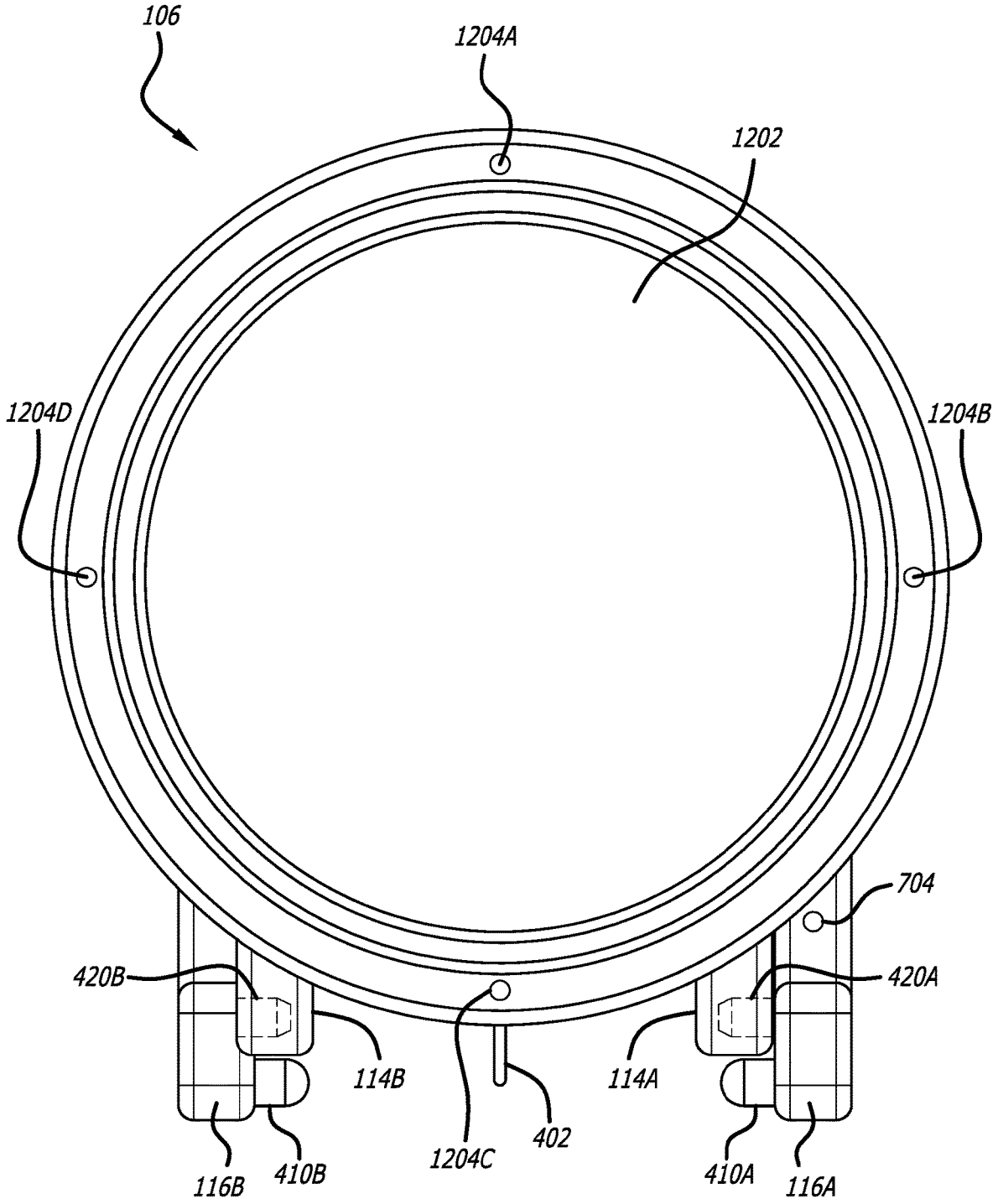
FIG. 12 illustrates a bottom view of the receptacle of FIG. 1.

Referring now to FIG. 12, an exemplary illustration of a bottom view of the container 102 is shown. The bottom 1202 of the receptacle 100 may include one or more drainage holes 1204A-1204D. The drainage holes 1204A-1204D provide an opening for liquids, such as water, to seep out of the bottom of the receptacle 100. In an alternative embodiment, not shown, the container 102 may include a tray into which the container 102 is placed that is configured to collect liquid that has drained from the items placed in the container 102 through the drainage holes 1204A-1204D.

Figure 13:
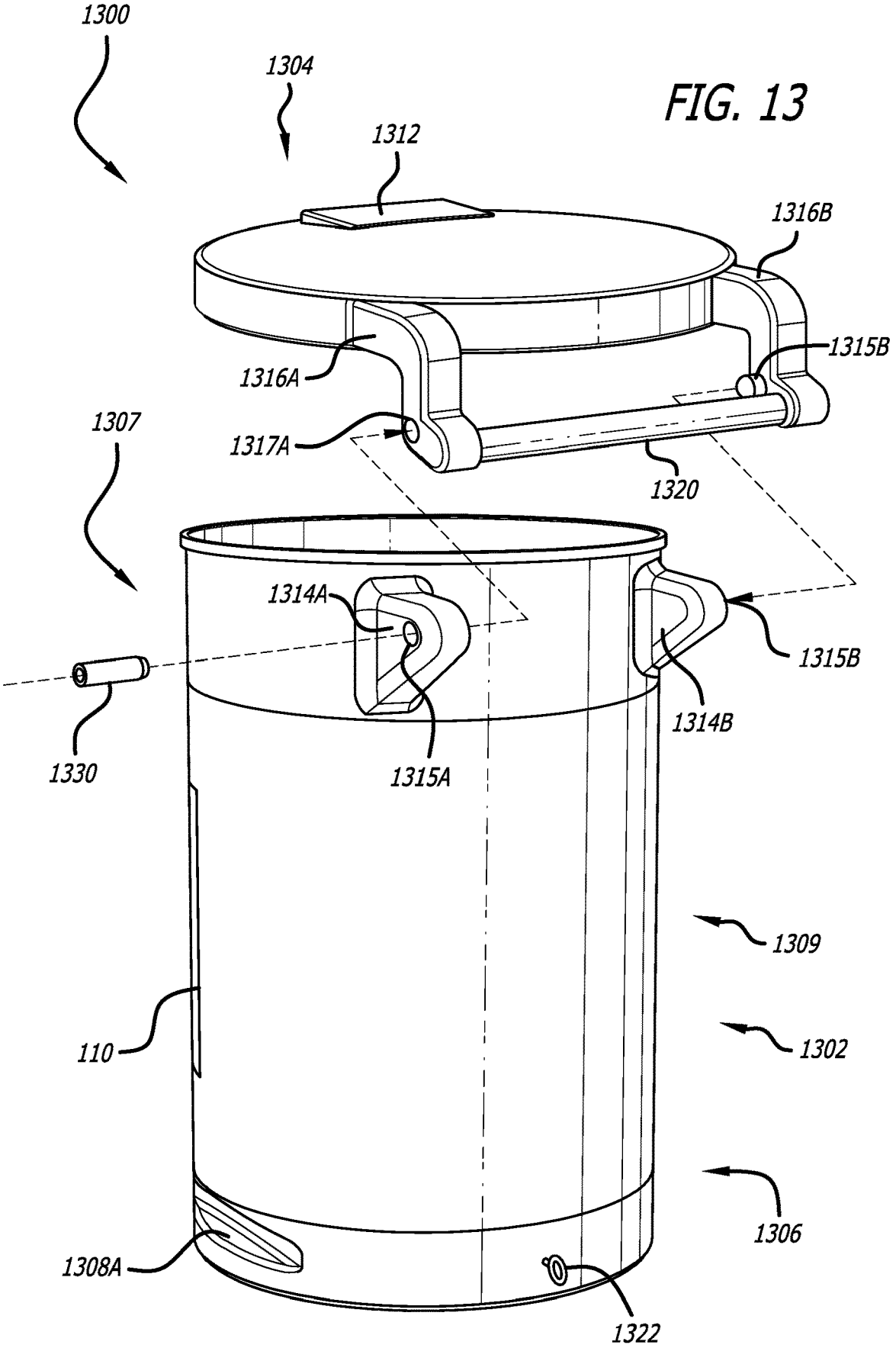
FIG. 13 illustrates a rear perspective view of a receptacle according to a second embodiment of the present invention.

Referring to FIG. 13, an exemplary illustration of a rear perspective view of a receptacle according to a second embodiment of the present invention is shown. The receptacle 1300 includes a container 1302 and a lid 1304. The container 1302 includes a top portion 1307, a center portion 1309, a base portion 1306 and a pair of knuckles 1314A-1314B, such that the container 102 may have the same construction as the container 102 of FIG. 1. The container 1302 may be integrally formed with the pair of knuckles 1314A-1314B as a single component. Additionally, the container 1302 may include one or more decals 1310 and one or more recesses 1308A. It should be noted that the decal 1310, like the decal 110 above, may be any shape and/or size configured to fit on the container 1302 and be removably attachable and/or permanently applied. The lid 1304 includes a pair of hinge components 1316A-1316B and a handle 1320 that may extend between the hinge components 1316A-1316B. The lid 1304, the hinge components 1316A-1316B and the handle 1320 may be integrally molded as a single component. The lid 1304 may also include a raised plate 1312. The raised plate 1312 may have various sizes and shapes and may include advertisements for companies, classifieds, event promotions, etc., and/or printed instructions for use and/or how to properly empty the receptacle 1300. In one embodiment, one or more of the container 1302 and the lid 1304 are rotationally molded.

The rear view of the receptacle 1300 illustrates an exploded view of the coupling between the hinge components 1316A-1316B and the knuckles 1314A-1314B. The lid 1304 couples to the container 1302 via the coupling of the hinge components 1316A-1316B with the knuckles 1314A-1314B. In one embodiment, illustrated in FIG. 13, a single hinge component (e.g., the hinge component 1316B) includes a pivot pin 1318B, that may be integrally molded as a single component with the hinge component 1316B. The pivot pin 1318B is configured to be inserted into a cavity 1315B located on the exterior of the knuckle 1314B and secured therein, thereby coupling the hinge component 1316B to the knuckle 1314B. Additionally, the hinge component 1316A may include a bore 1317A that is drilled through the width of the hinge component 1316A that is configured to receive a sleeve 1330 (e.g., a removably insertable locking pin). Herein, the sleeve 1330 may pass at least partially through the hinge component 1316A and partially or wholly through the knuckle 1314A via the bore 1315A, thereby coupling the hinge component 1316A to the knuckle 1314A. The diameter of the cylindrical sleeve is approximately equal to the diameter of the bores 1315A and 1317A so that the sleeve is "press fit" into these bores. Alternatively, the sleeve 1330 may be inserted through bore 1315A of the knuckle 1314A and become inserted into a cavity 1317A of the hinge component 1316A that is aligned with the bore 1315A of the knuckle 1314A. Yet another alternative embodiment, the sleeve 1330 may be inserted through bore 1317A of the hinge component 1316A and is partially inserted into a cavity 1315A of the knuckle 1314A. Any of these embodiments is configured to utilize the sleeve 1330 to achieve a rotational coupling between the hinge component 1316A and the knuckle 1314A.

The insertion of the pivot pin 1318B into the cavity 1315B of the knuckle 1314B and the insertion of the sleeve 1330 through the hinge component 1316A and at least partially into the bore 1315A secure the lid 1304 to the container 1302. One benefit provided by coupling the lid 1304 and the container 1302 via the pivot pin 1318B and the sleeve 1330 to the knuckles 1314A-1314B is that no metal components are required in such an embodiment. The effects of the corrosion of metal, as discussed above, also apply to the embodiment illustrated in FIG. 13. Therefore, like the receptacle 100 discussed above, the receptacle 1300 provides significant benefit over alternative receptacle options that utilize metal components, especially when used to couple the lid to the container.

Additionally, the knuckles 1314A-1314B are configured such that at least one (and perhaps both) contacts the handle 1320 during the rotated opening of the lid 1304, thereby preventing the lid 1304 from opening beyond a predetermined angle. Thus, as the lid 1304 is opened, the lid 1304 and the hinge components 1316A-1316B rotate about the knuckles 1314A-1316B. When the lid 1304 is opened to the predetermined maximum angle, the handle 1320 contacts at least one of the knuckles (e.g., knuckle 1314B) and prevents the lid 1304 from opening any further. It is further contemplated that the knuckles 1314A-1314B may be sized so that the handle 1320 may contact an outer surface of the container 1302 upon opening the lid 1304.

Figure 14A:
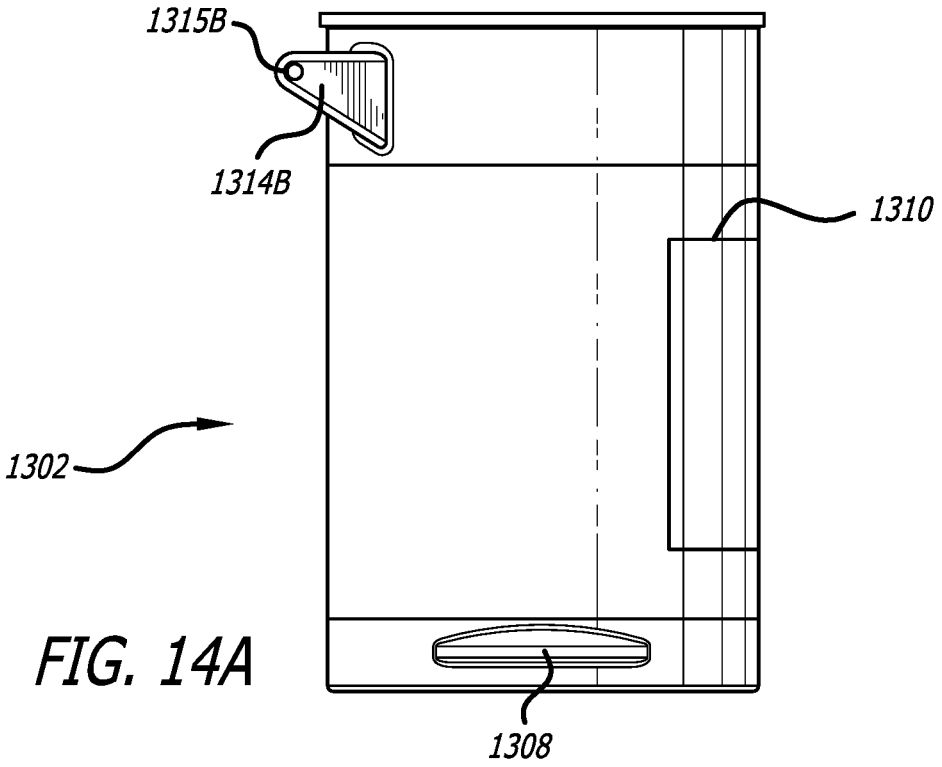
FIG. 14A illustrates a side perspective view of the container of the receptacle of FIG. 13.
Figure 14B:
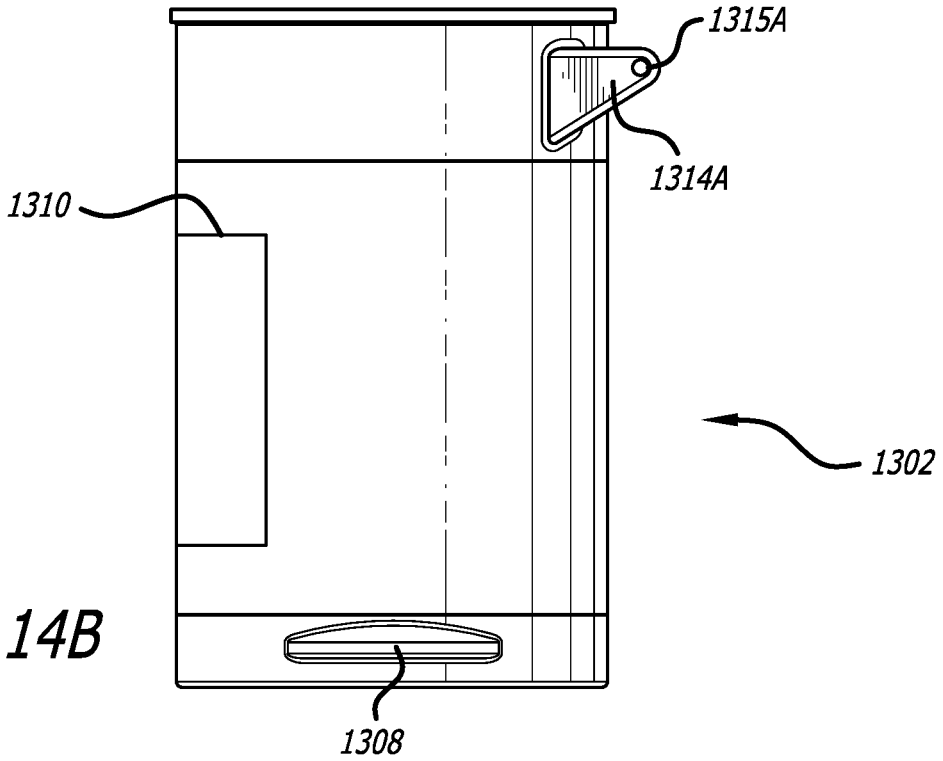
FIG. 14B illustrates a second side perspective view of the container of the receptacle of FIG. 13.

As with the receptacle 100, the receptacle 1300 may include one or more hooks 1322, e.g., an eye bolt that can be used to secure the receptacle 1300 at a certain location or to a particular item. The hook 1322 can secure the receptacle 1300 via a chain and lock combination or with an alternative locking method. In one embodiment, the hook 1322 may be located near the base of the container 1302, e.g., near the base portion 1306. Further, a chain can attach to the hook 1322 and wrap around the base portion 1306 of the container 1302 and rest in the recesses 1308A-1308B. In alternative embodiments, the hook 1322 can be located elsewhere on the receptacle 1300. FIG. 14A provides an exemplary illustration of a side perspective view of the receptacle 1300 and FIG. 14B provides an exemplary illustration of a second side perspective view of the receptacle 1300. In one embodiment, as illustrated in FIGS. 14A-14B, the bore 1315A and the cavity 1315B may each have a diameter of under one (1) inch (e.g., approximately 0.88 inches). However, one or more of the bore 1315A and the cavity 1315B may have other measurements.

Figure 15A:
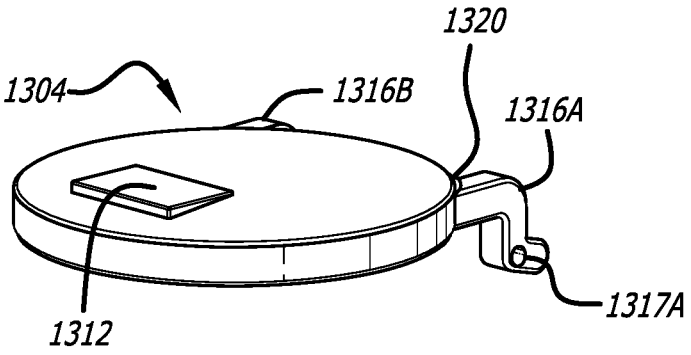
FIG. 15A illustrates a lid that can be used with the receptacle of FIG. 13.
Figure 15B:
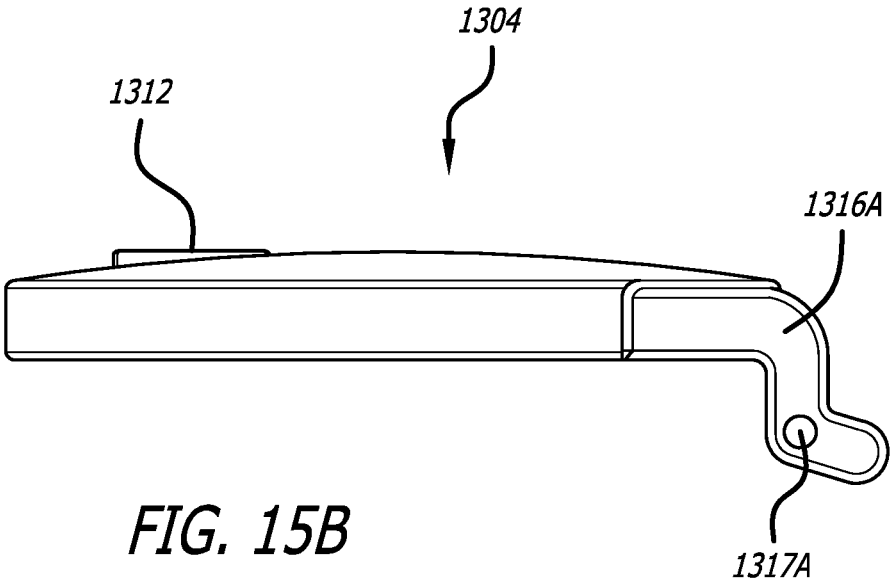
FIG. 15B illustrates a side perspective view of the lid of FIG. 15A.

FIG. 15A provides an exemplary illustration of the lid 1304 and FIG. 15B provides an exemplary illustration of a side view of the lid 1304. The side view of FIG. 15B provides an illustration of the hinge component 1316A including the bore 1317A. In one embodiment, as shown, the center of the bore 1317A may be located approximately one inch from the inner edge of the hinge component 1316A. Although, in alternative embodiments, the center of the bore 1317A may be located at other distances from the inner edge of the hinge component 1316A depending on, for example, the width of the hinge component 1316A and/or the diameter of the bore 1317A.

Figure 15C:
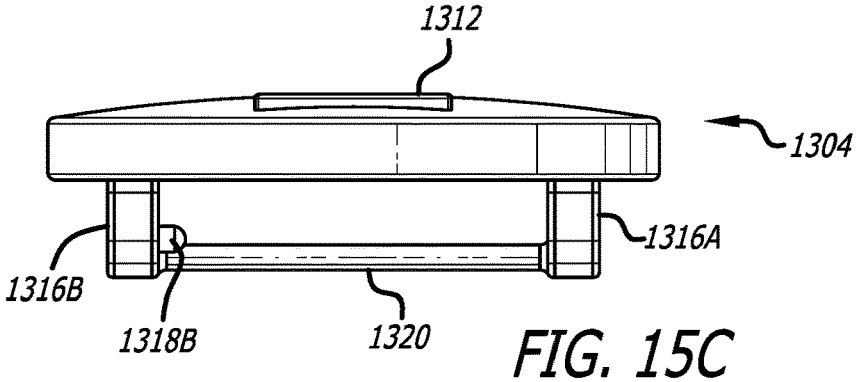
FIG. 15C illustrates a front view of the lid of FIG. 15A.
Figure 15D:
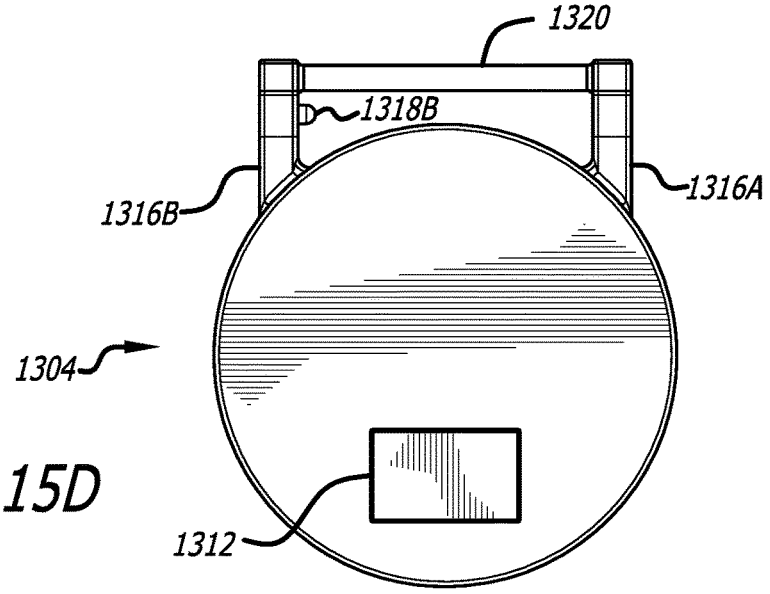
FIG. 15D illustrates a top view of the lid of FIG. 15A.

FIG. 15C provides an exemplary illustration of a front view of the lid 1304 of FIG. 15A and FIG. 15D provides an exemplary illustration of a top view of the lid 1304 of FIG. 15A. Various example measurements are provided in the illustration of FIG. 15D. For instance, the embodiment illustrated in FIG. 15D provides that the pivot pin 1318B possesses a thickness of under one (1) inch (e.g., approximately 0.75 inches) and a length of over one (1) inch (e.g., approximately 1.25 inches). Further, the handle 1320 is seen to possess a thickness of over one (1) inch (e.g., approximately 1.38 inches). However, these measurements are merely optional and are not intended to limit the disclosure.

Figure 16A:
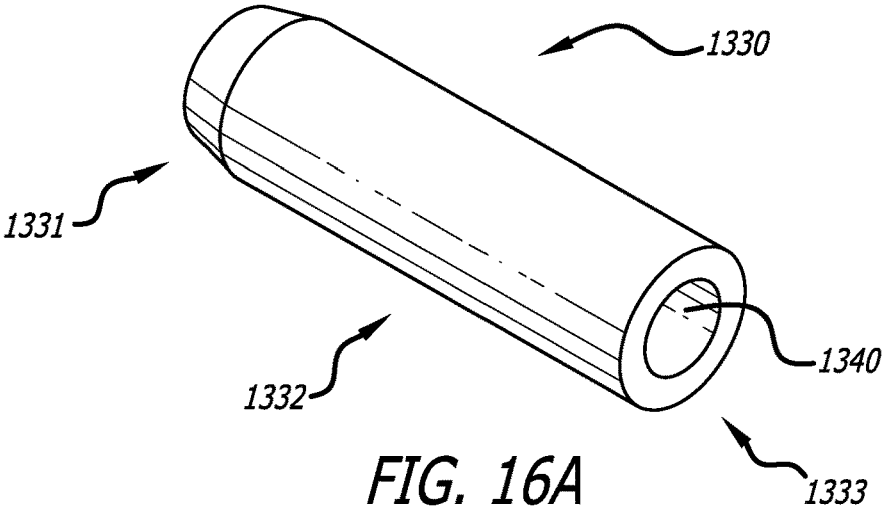
FIG. 16A illustrates a rear perspective view of a sleeve that can be used with the receptacle of FIG. 13.
Figure 16B:
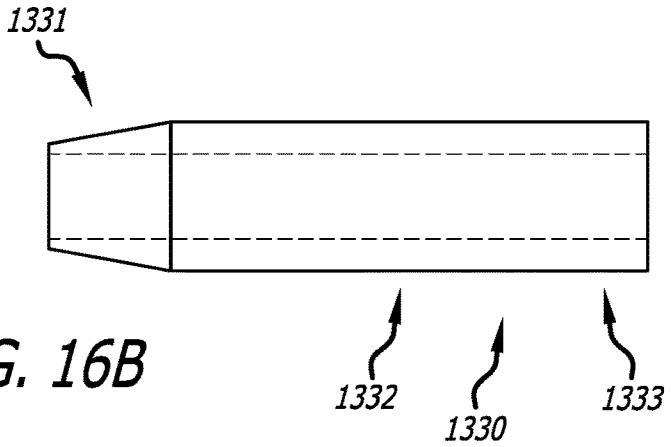
FIG. 16B illustrates a side view of the sleeve of FIG. 16A.

Referring to FIG. 16A, an exemplary illustration of a rear perspective view of a sleeve that can be used with the receptacle of FIG. 13 is shown. The sleeve 1330 may include a front portion 1331, a center portion 1332, an end portion 1333 and a lumen, e.g., a bore 1340, that extends partially or wholly through the sleeve 1330. FIG. 16B provides an exemplary illustration of a side view of the sleeve of FIG.

16A. Various measurements are provided in FIG. 16B. For example, FIG. 16B provides that the sleeve 1330 possesses a length of three (3) inches. Additionally, the front portion 1331 of the sleeve 1330 may have a length of under one (1) inch (e.g., approximately 0.33 inches) be slanted upward at an angle of fifteen (15) degrees. However, these measurements are merely optional and are not intended to limit the disclosure.

While the invention has been described in terms of several embodiments, those skilled in the art will recognize that the invention is not limited to the embodiments described, can be practiced with modification and alteration within the spirit and scope of the appended claims. The description is thus to be regarded as illustrative instead of limiting.

What is claimed is:

1. A receptacle, comprising:

a container including one or more walls and a plurality of gussets extending from a wall of the one or more walls forming the container, wherein a first gusset of the plurality of gussets includes a cavity facing outwardly and away from a second gusset of the plurality of gussets, the second gusset includes a cavity facing outwardly and away from the first gusset; and a lid including a plurality of hinge components, a first hinge component of the plurality of hinge components including a first pivot pin and a first protrusion and a second hinge component of the plurality of hinge components including a second pivot pin, the lid being pivotally coupled to the container by inserting the first pivot pin of the first hinge component into the cavity of the first gusset and using the second pivot pin to rotationally couple the second hinge component to the second gusset, wherein the first gusset includes an angular outer surface extending from the wall of the container and the first protrusion extending from the first hinge component to contact the angular outer surface of the first gusset during rotated opening of the lid to restrict the opening of the lid.

2. The receptacle of claim 1, wherein the container and the lid are molded from polyethylene.

3. The receptacle of claim 1, wherein an exterior of the lid includes a raised plate, the raised plate being structured to include at least one of (i) an advertisement corresponding to a decal attached to an outer surface of the raised plate of the container or (ii) instructions for use of the receptacle.

4. The receptacle of claim 1, wherein the first pivot pin of the first hinge component and the second pivot pin of the second hinge component are oriented in a direction toward each other and inserted into the cavity of the first hinge component and the cavity of the second hinge component facing in a direction opposite to each other.

5. The receptacle of claim 1, wherein the lid and the plurality of hinge components are integrally formed as a single component.

6. The receptacle of claim 1, wherein the plurality of gussets are integrally molded with the one or more walls forming the container to form a single component.

7. The receptacle of claim 1, wherein each of the plurality of gussets corresponds to gusset-like protrusions extending from the wall of the container.

8. A receptacle, comprising:

a container including one or more walls and a plurality of gussets extending from an outer surface of a first wall of the one or more walls, wherein each gusset of the plurality of gussets includes a cavity facing an opposite direction from gusset of the plurality of gussets; and a lid including a plurality of hinge components, at least one of the plurality of hinge components including a stop pin, the lid being hingedly coupled to the container via a coupling of the hinge components and the plurality of gussets, wherein the stop pin of the at least one of the plurality of hinge components is configured to contact an angular outer surface of a corresponding gusset of the plurality of gussets extending from a wall of the container when the lid is opened to a predetermined angle and to prevent the lid from opening beyond the predetermined angle.

9. The receptacle of claim 8, wherein the container and the lid are molded from polyethylene.

10. The receptacle of claim 8, wherein an exterior surface of the lid includes a raised plate, the raised plate being structured to include at least one of (i) an advertisement or (ii) instructions for use of the receptacle.

11. The receptacle of claim 8, wherein each hinge component of the plurality of hinge components includes a stop pin, each stop pin being configured to contact a corresponding gusset of the plurality of gussets when the lid is opened to the predetermined angle.

12. The receptacle of claim 8, wherein the lid is opened to the predetermined angle when the stop pin of the at least one of the plurality of hinge components makes contact with the corresponding gusset to preclude further opening of the lid and, at the predetermined angle, the lid is predisposed to close after being opened.

13. The receptacle of claim 8, wherein the lid and the pair of hinge components are integrally formed as a single component.

14. The receptacle of claim 8, wherein the plurality of gussets are integrally molded with the one or more walls forming the container to form a single component.

15. The receptacle of claim 8, wherein the lid includes a lip that extends in a downward direction when closed and surrounds a portion of the container.

16. A receptacle, comprising:

a container including one or more walls and a plurality of gussets each being a protrusion extending from an exterior surface of a portion of the one or more walls and including an outer angular surface, wherein a first gusset of the plurality of gussets includes a cavity facing in a first direction and a second gusset of the plurality of gussets includes a cavity facing in a second direction opposite to the first direction; and a lid including a plurality of hinge components, a first hinge component of the plurality of hinge components including a pivot pin, the lid being rotationally coupled to the container by inserting the pivot pin of the first hinge component into the cavity of the first gusset and inserting a locking pin through both a bore in the second gusset and a bore in a second hinge component of the plurality of hinge components to rotationally couple the second hinge component to the second gusset, wherein a first protrusion extends from the first hinge component and is configured to contact the outer angular surface of the first gusset when the lid is opened to restrict opening of the lid.

17. The receptacle of claim 16, wherein the container and the lid are molded from polyethylene.

18. The receptacle of claim 16, wherein an exterior of the lid includes a raised plate, the raised plate including an advertisement.

19. The receptacle of claim 16, wherein the lid and the plurality of hinge components are integrally formed as a single component.

20. The receptacle of claim 16, wherein the plurality of gussets are molded with the one or more walls forming the container to integrally form a single component.

21. The receptacle of claim 16, wherein the outer angular surface extending downward from a first surface of the first gusset that is substantially in parallel with an exterior surface of a first wall of the one or more walls and an end of the outer angular surface in contact with the exterior surface of the first wall.

* * * * *